United States Patent [19]

Hurd et al.

[11] 4,234,233

[45] Nov. 18, 1980

[54] CHAIN DRIVEN CUTTING BUCKET FOR USE IN DEEP MINING

[76] Inventors: Robert L. Hurd, 2063 Manor Dr., Lexington, Ky. 40502; Donald C. MacGregor, 13 Hunters Trail, Warren, N.J. 07060

[21] Appl. No.: 13,750

[22] Filed: Feb. 21, 1979

[51] Int. Cl.[3] ..... E21C 35/20

[52] U.S. Cl. ..... 299/34; 299/43; 299/67; 299/84; 414/387

[58] Field of Search ..... 299/32, 34, 35, 43, 299/45, 67; 414/378, 387

[56] References Cited

U.S. PATENT DOCUMENTS

| | | | |
|---|---|---|---|
| 3,487,963 | 1/1970 | Thornander | 414/387 |
| 3,620,392 | 11/1971 | Tingley | 414/387 |
| 4,065,184 | 12/1977 | Tipper | 299/45 X |

FOREIGN PATENT DOCUMENTS

| | | | |
|---|---|---|---|
| 1268084 | 5/1968 | Fed. Rep. of Germany | 299/34 |
| 801675 | 9/1958 | United Kingdom | 299/34 |

*Primary Examiner*—Ernest R. Purser

[57] ABSTRACT

A bucket is disclosed for both chipping coal from a coal seam and for removing the coal from the seam. The bucket is arranged for flexible coupling to preceding and succeeding buckets to form a continuous train for rotation through a coal tunnel. Along the side of each bucket there is mounted a cutting blade for dislodging the coal. A ramp on the side of the bucket serves to scoop the dislodged coal into the bucket. When the bucket emerges from the mine tunnel the bottom of the bucket falls away and the coal is unloaded directly into waiting hoppers.

8 Claims, 8 Drawing Figures

| BIT SPACING SEQUENCE ——— R, F, 4, 2, 8, F, R, 1, 6, F, 9, 1 REPEAT _ _ _ _ _ |
|---|

CHAIN DRIVEN CUTTING BUCKET FOR USE IN DEEP MINING

FIELD OF THE INVENTION

This invention is in the field of mining techniques and, more particularly, relates to bucket and cutter combination for removing coal from a coal tunnel.

BACKGROUND OF THE INVENTION

In concurrently filed copending application Ser. No. 13749 there is disclosed a technique for mining coal from horizontal coal seams without the need for humans to enter the coal tunnels. Such a technique relies on a continuously moving set of cutters driven from the outside of the mine tunnel and arranged to dislodge the coal from the seam. In order to most effectively utilize the inventive concepts taught in said application, it is necessary to have a structure for cutting the coal from the sides, top and bottom of the tunnel, as well as for removing the dislodge coal.

Thus, a need exists for a combination coal cutter and bucket arranged to remove coal from a tunnel under power derived exterior from the tunnel.

A further need exists in the art for such a cutter and bucket arrangement which may form a continuous interlinked train for moving through a tunnel, or around a mountain, while at the same time both chipping coal from the seam and scooping that coal into the bucket for removal to a remote location.

SUMMARY OF THE INVENTION

There is disclosed a combination cutter and scoop which serves to cut coal from the sides, top and bottom of a coal tunnel as well as to scoop the dislodged coal into a bucket for removal from the tunnel. In one embodiment, the bucket is arranged with a hinged bottom so that when the bucket leaves the tunnel, the bottom of the bucket falls away, allowing the coal to fall into waiting hoppers. A ramp on the side of the bucket serves to scoop the chipped coal from the tunnel floor into the bucket as it is being driven through the tunnel.

Each bucket is equipped with hinges at the forward and trailing ends for flexible connection with the bucket ahead and behind.

In operation, the buckets form an interlinked train with the hinges serving to allow the assembly to go around obstructions and curves in the manner discussed in detail in said copending application, which is hereby incorporated by reference herein as if it had been repeated in its entirety.

DETAILED DESCRIPTION

Figure 1:
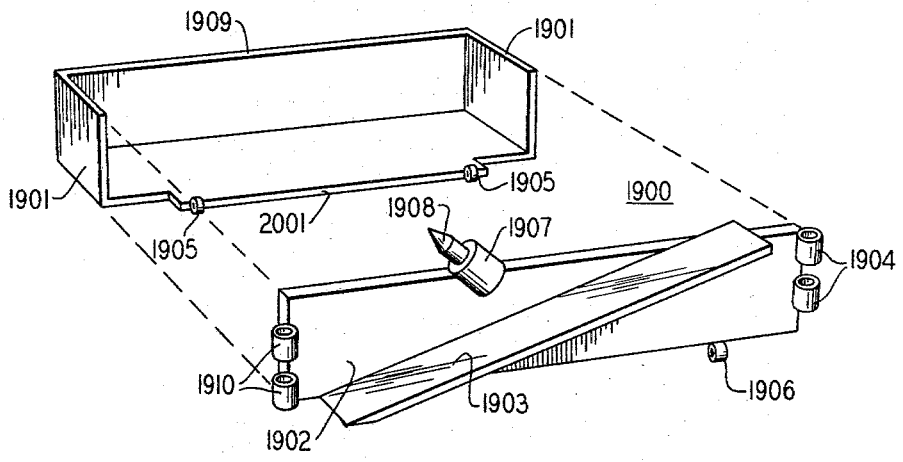
FIG. 1 shows an exploded view of the bucket and cutter

Turning now to FIG. 1, there is shown a bucket assembly in exploded view format. Such a bucket is attached to the bucket ahead of it by hinge 1904 and to the bucket behind it by hinge 1910 in the manner shown in FIGS. 4 and 5. The buckets are arranged, as discussed in the aforementioned patent application to Hurd, to form a continuous, or substantially continuous, interlinked train. Each bucket may have one or more cutters 1908 on its side, each cutter serving to chip coal from a particular level of the coal seam. The buckets may have a continuous cutter along its side for chipping coal across the entire face of the tunnel, if so desired. Also, each bucket may have more than one such individual cutter mounted thereon. By arranging the cutters in a specified order according to position, the coal may be mined in a uniform manner throughout the tunnel. For ease of discussion, it will be assumed herein that each bucket has mounted thereon a single cutter positioned at a particular height relative to the floor of the tunnel. While each cutter is shown individually welded onto the outer surface of the bucket side, there could be preset assemblies positioned along the side, vertically displaced, for snapping cutter blades into as the need arises.

Figures 6, 7:
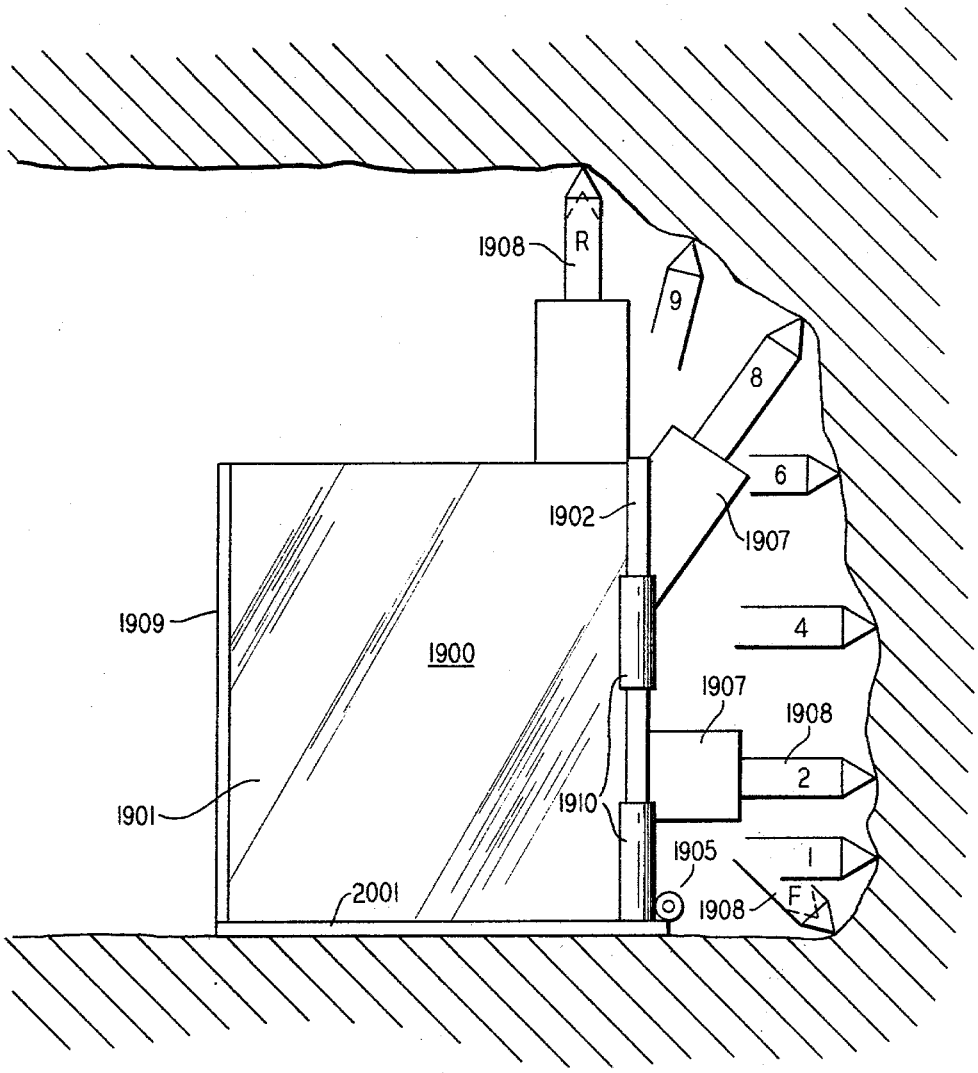
FIG. 6 shows the cutting assembly
FIG. 7 shows the bit spacing sequence.

Thus, in FIG. 6, there can be seen several of the positions where cutters should be mounted. The cutter holder 1907 may be welded, bolted or otherwise attached to the bucket so that blades 1908 attached to each holder are at certain positions. Thus, blade F is the floor cutting blade and may be arranged for various distances from the bucket, depending on the slope or unevenness of the floor. For example, if the floor of the tunnel is bumpy then the F cutter can be extended only slightly so as to cut away only the tops of the bumps. As these tops are reduced, the F cutters can be extended so that eventually the entire floor is level. The same procedure can be followed with the roof cutting blade R. One suggested cutter spacing is shown in FIG. 7, where each blade is carried by a separate bucket following one after the other in the pattern shown. The sequence shown is for a typical ten inch cut. To insure a smooth floor, cut three cutter bits of the twelve bit sequence will be cutting at the floor level, while two will be cutting at the one inch level. Two bits (numbered "1" in FIG. 6) will be cutting at the one inch level. Note that the bits are alternated on adjacent buckets so that one bit cuts high while the next following bit cuts low. This alternation will tend to balance the forces on the system and to keep the sides of the tunnel relatively square.

Figure 8:
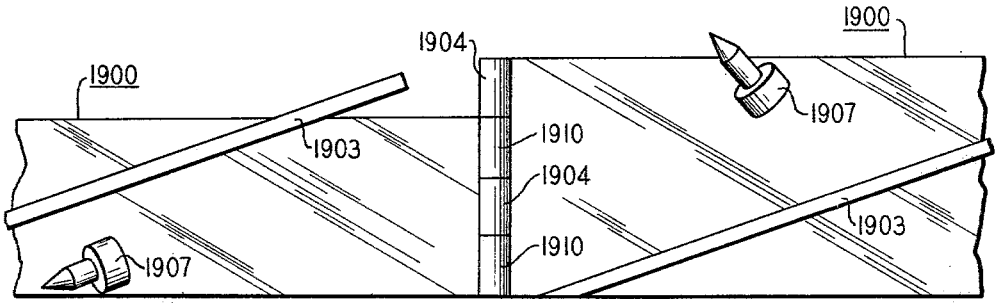
FIG. 8 shows two buckets hinged together.

As the cutters chip away the coal, it is free to fall into the bucket or onto the tunnel floor. On the side of each bucket, there is mounted a slide which serves to scoop the coal from the floor up into the bucket for removal from the tunnel. Each bucket is arranged, as will be discussed, so that as the floor falls away when the bucket comes out of the tunnel, the coal is dumped into waiting hoppers. Different size buckets may be used, some with lower sides, as shown in FIG. 8 so as to insure adequate clearance for the coal to enter the moving buckets. The size of the buckets depends upon the height of the coal seam and one size may serve many differing height seams simply by varying the position and extension of the cutter holders 1907.

Since it is important to eliminate the human element from the tunnels, TV cameras or other monitoring devices, such as gas detectors, radar, recorders, may be mounted on special buckets for the purpose of surveillance of the mining operation.

In addition, each cutter may be spring loaded or mechanically moveable and remotely or automatically moveable so that the position of a blade may be changed in various places along the tunnel. Such adjustment may occur as a result of preset signals or under control of an external operator, as, for example, by radio signals transmitted to a particular bucket.

Such a bucket 1900 is shown in exploded view format in FIG. 1 and consists of a side plate 1902 to which a ramp 1903 is attached, preferably by welding. Cutter assembly 1907, 1908 is mounted to plate 1902 in a position discussed previously. More than one such blade may be attached to plate 1902. Hinges 1904 and 1910 are positioned as shown along the trailing and leading ends of plate 1902 and serves to connect each bucket with the preceeding and following buckets, as shown in FIG. 8.

Figure 2:
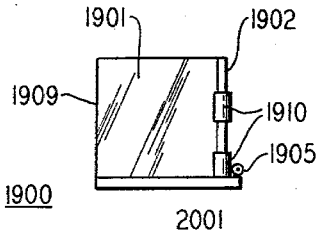
FIG. 2 shows a partial side view with the bucket closed.
Figure 3:
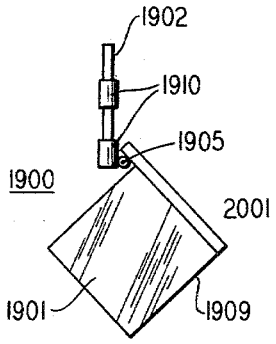
FIG. 3 shows a partial side view with the bottom open.

At the base of plate 1902, there is shown hinges 1905 which serve to connect plate 1902 to the bottom plate 2001 of the bucket assembly. Connected to bottom plate 2001 are two side plates 1901 and 1909. When bottom plate 2001 is being supported by the floor of the tunnel, then the structure that results is a closed box or bucket into which coal, which is chipped from the tunnel by the blade assemblies, may be carried out of the tunnel. Once on the outside of the tunnel, a dummy floor is constructed so that the bucket will remain closed. In this manner, the coal in the bucket is transported to a hopper or coal chute. When the bucket is positioned, under control of the moving train, over the coal receptical area, the dummy floor terminates, thereby allowing the bucket to swing open via hinge assembly 1905, 1906 and, as shown in FIG. 3, the bucket tilts and the coal spills therefrom. A ramp is used to close the bucket before it reenters the tunnel. In FIG. 2, the bucket is shown in the closed position being supported either by the tunnel floor (not shown) or by a dummy floor outside of the tunnel (not shown).

Figure 4:
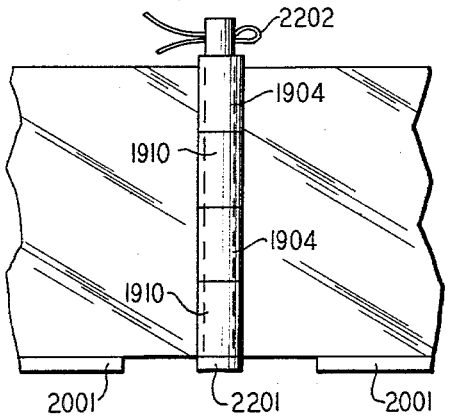
FIGS. 4, and 5 show hinge assemblies between two buckets.

In FIG. 4, there is shown a cotter pin 2201 or large bolt inserted into the hinge assemblies 1904, 1910 between the buckets. A cotter pin, castle nut, or similar device serves to hold the assemblies together. Since each bucket is hinged to the bucket in front and behind, the assembly is free to turn corners in the same manner as does a train.

Figure 5:
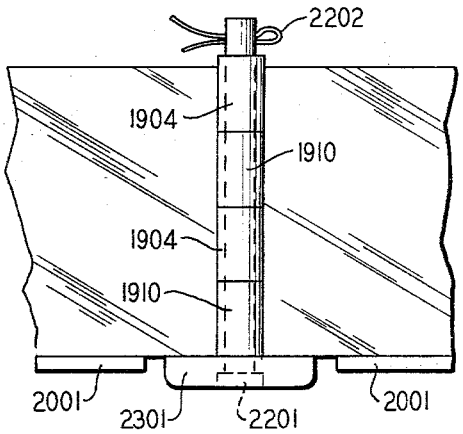

In situations where correction or drift compensation is needed, a spacer 2301, FIG. 5, is inserted, which spacer rides on the floor of the tunnel, thereby maintaining the buckets in the proper plane.

As shown in FIG. 8, buckets 1900 can be of varying sizes and the cutters 1907 may be mounted above or below ramp 1903.

As shown in FIG. 17 of the aforementioned copending application, a large structure 1701 is constructed outside of the mine tunnel and holds circulating table 1702 having arm 1703 positioned to engage hinge assembly 1904, 1910. The purpose of such engagement is to impart constant outward force, as shown in FIG. 14 of said application, on the bucket train. This is accomplished by hydraulic cylinder 1401, causing table 1702 to slide outward via slide plate 1402. If additional forward power is necessary, the table can be powered by a rotary motor. As shown in FIG. 18 of said application, arm 1703 has a top half 1801 and a bottom half 1802 mounted to table 1702. The table is driven, if necessary, by a motor connected to the center 1803.

Also, as shown in FIG. 14 of said application, power station 1403 is designed to impart forward momentum to the bucket train via arms 1404 and 1405.

FIG. 15 of said application, shows a top view of power station 1403 where a chain drive 1607 has mounted thereto a first arm 1405 for engaging the leading hinge assembly 1710 of a bucket and a second arm 1404 for engaging the trailing hinge assembly 1904 of a bucket. More than one such pair of arms will be mounted to the chain drive which typically can be roller chain with five inch pitch ANSI #4020 such as Union Chain #US 5031. The roller chain is driven by a power source 1501 and turns on sprocket 1605. The arms are spaced along the chain so that at least one of the arms is in contact with a hinge assembly at all times.

The purpose of the power station is to maintain the interlinked buckets moving through the tunnel, and of course, there may be as many power stations as necessary.

Before the bucket arrives at the power station, the floor terminates so that the bucket, as discussed previously, will open dumping its contents into a hopper or other dumping area. Thus, as the bucket approaches the power station, it has the shape shown in FIG. 2 with plate 1902 sticking up. On one side of plate 1902 the hinge assembly is engaged by arm 1405 or 1404, shown in said copending application. The other side of plate 1902 is engaged by rubbing block 1502, shown in FIG. 16 of said copending application. Rubbing block 1502 maintains plate 1902 in contact with arm 1404 or arm 1405. Arm 1404 and 1405 is driven forward by chain 1607 which, in turn, is driven by sprocket 1605 splined by spline 1608 to shaft 1609 of motor 1602.

A review of the drawing as well as the said concurrently filed application of Hurd will reveal that the side hinges which are mounted fore and aft on each bucket serve a dual function; namely, interlinking the buckets to the one ahead and to the one behind as well as serving as a protrusion which may be seized by the external power source for the purpose of applying power and forward momentum to the entire interlinked train. Thus, it is possible for the entire system to be rotated from outside a mine tunnel by power applied to each car in turn from a rotating power source, the full details of which are shown in said copending application.

It should be noted that while it is contemplated that the buckets will form a continuous train, such may not be necessary in all applications. In such situations a chain drive, or other coupling, may be inserted instead of one or more buckets.

CONCLUSION

While one structure has been shown for scooping and chipping coal from a seam, variations may be adapted to fit particular requirements by those skilled in the art without departing from the spirit and scope of our invention.

What is claimed is:

1. A bucket for chipping coal from a coal seam, said bucket having two sides, a front, a back, and a bottom, each of said sides having an inner surface facing the inside of said bucket and an outer surface facing outward from said bucket, means for hinging said bottom to a first one of said sides at a bottom surface of said first side, a first set of hinges at the leading edge of said first side, a second set of hinges at the trailing edge of said first side, said second set of hinges positioned so as to flexibly engage the first set of hinges of a trailing one of said buckets, a ramp affixed to said outer surface of said first side, and sloping upward from said leading edge to said trailing edge of said first side, the top end of said ramp extending beyond the top surface of said first side, a cutting assembly mounted on said outer surface of said first side, said assembly adapted for chipping coal from a coal seam coming into contact therewith, and wherein said second side, said front, said back and said bottom are rigidly affixed to each other to form a bucket assembly for receiving said chipped coal and wherein said first side is flexibly attached to said bottom by said bottom hinge in a manner such that when upward pressure is placed under said bottom said bucket will contain any coal placed therein and such that when said upward pressure is removed from said bottom said bucket assembly will tilt away from said first side, spilling said contained coal.

2. The invention set forth in claim 1 wherein said cutting assembly is vertically adjustable along said first side.

3. The invention set forth in claim 2 wherein said cutting assembly is adjustable so that the cutting edge of said assembly can be variably displaced from said first side in a plane perpendicular to said first side.

4. The invention set forth in claim 1 wherein the leading edge of each said bucket is height adjustable by the placement of a spacer in conjunction with said first set of hinges.

5. The invention set forth in claim 1 wherein said bucket is adapted for use in an interlinked mining operation where a plurality of said buckets are interconnected by said hinge assemblies and where said interlinked bucket train is rotated around a seam of material which is to be removed by a power source remote from the location where said material is to be removed and wherein said hinges are adapted to engage said remote power source, thereby imparting momentum to said interlinked train.

6. A solid material removing assembly for use in a mining operation where a plurality of said assemblies are interlinked and rotated around said material to be removed by a power source remote from the location where said material is to be removed, said assembly comprising, a bucket having a first side and a second side parallel to each other, a trailing end and a leading end parallel to each other and a bottom plate having a hinge along one edge; said trailing end, said leading end, and said second side rigidly affixed to said bottom plate along the edges of said bottom plate other than the edge to which said hinge is affixed, a leading edge hinge assembly affixed to the leading edge of said first side, a trailing edge hinge assembly affixed to the trailing edge of said first side, said hinge assemblies adapted to flexibly mate with the hinge assemblies of the bucket ahead and the bucket behind, a bottom hinge assembly affixed to the bottom edge of said first side and arranged to flexibly mate with said bottom plate hinge assembly, a ramp rigidly affixed to the outer surface of said first side, said ramp sloping upward from the leading edge of said first side toward the trailing edge and extending above the top surface of said first side, and a cutting blade mounted on said outer surface of said first side.

7. The invention set forth in claim 6 further comprising means for adjusting the height of said blade assembly.

8. The invention set forth in claim 7 further comprising means for adjusting the cutting distance of said blade, as measured from said first side.

* * * * *